US007527218B2

(12) United States Patent
Brown

(10) Patent No.: US 7,527,218 B2
(45) Date of Patent: May 5, 2009

(54) COMBINATION SANITARY WIPE AND TOILET TISSUE HOLDER

(76) Inventor: Aaron Brown, 610 N. Willow Springs La., Glendora, CA (US) 91741

( * ) Notice: Subject to any disclaimer, the term of this patent is extended or adjusted under 35 U.S.C. 154(b) by 291 days.

(21) Appl. No.: 11/480,647

(22) Filed: Jul. 3, 2006

(65) Prior Publication Data

US 2008/0001019 A1 Jan. 3, 2008

(51) Int. Cl.
*B65H 16/04* (2006.01)

(52) U.S. Cl. ..... 242/597.8

(58) Field of Classification Search ..... 242/597.8; D6/519, 523, 524
See application file for complete search history.

(56) References Cited

U.S. PATENT DOCUMENTS

| | | | | | |
|---|---|---|---|---|---|
| 3,943,859 | A * | 3/1976 | Boone | 108/27 |
| 4,106,617 | A * | 8/1978 | Boone | 206/233 |
| 4,235,333 | A * | 11/1980 | Boone | 206/233 |
| 5,012,986 | A * | 5/1991 | Needle | 242/597.6 |
| 5,311,986 | A * | 5/1994 | Putz | 206/233 |
| D377,284 | S * | 1/1997 | Farrow et al. | D6/519 |
| 5,618,008 | A * | 4/1997 | Dearwester et al. | 242/594.5 |
| D421,690 | S * | 3/2000 | Sutherland | D6/520 |
| 6,047,920 | A * | 4/2000 | Dearwester et al. | 242/594.5 |
| D452,944 | S * | 1/2002 | Schmidt | D34/6 |
| 6,497,345 | B1 * | 12/2002 | Wilker et al. | 222/192 |
| 6,604,628 | B1 * | 8/2003 | Tanaka et al. | 206/209 |
| 6,682,013 | B1 * | 1/2004 | Newman et al. | 242/598.6 |
| 6,696,025 | B2 * | 2/2004 | Liao | 422/123 |
| D493,313 | S * | 7/2004 | Hoernig | D6/524 |
| 6,959,890 | B1 * | 11/2005 | Breitinger | 242/592 |
| D521,289 | S * | 5/2006 | Breitinger | D6/524 |
| 7,070,143 | B2 * | 7/2006 | Faulks et al. | 242/598.6 |
| D529,320 | S * | 10/2006 | Corral | D6/518 |
| 7,294,378 | B2 * | 11/2007 | Rivera et al. | 428/36.91 |
| D559,597 | S * | 1/2008 | Corral | D6/518 |
| D559,599 | S * | 1/2008 | Bickler et al. | D6/523 |
| 7,354,598 | B2 * | 4/2008 | Masting | 424/443 |
| 2006/0124799 | A1 * | 6/2006 | Johnson | 242/594.3 |

* cited by examiner

*Primary Examiner*—William A Rivera
(74) *Attorney, Agent, or Firm*—Frederick Gotha

(57) ABSTRACT

The invention relates to a combination hygienic device for holding sanitary wipes or toiletries and for dispensing a roll of toilet tissue paper. The device consists of a sanitary tray having a void region for receiving a sleeve member so dimensioned and proportioned to permit insertion of the sleeve into the void region. A cover is pivotally mounted to the sanitary tray for permitting access to a cavity contained in the sleeve member where the sanitary wipes or toiletries may be stored. A holder member is removably mounted to the bottom-wall of the sanitary tray for holding a roll of toilet tissue paper in telescopic and rotational relationship with the holder member to permit the dispensing of the toilet tissue paper.

18 Claims, 3 Drawing Sheets

COMBINATION SANITARY WIPE AND TOILET TISSUE HOLDER

FIELD OF THE INVENTION

This invention relates to a bathroom hygiene combination device for holding sanitary wipes and dispensing a roll of toilet tissue paper.

BACKGROUND OF THE INVENTION

Toiletries such as sanitary wipes are not readily accessible in conventional bathroom designs and generally are stored in bathroom cabinets until they are to be used. The cabinets are not in the vicinity of the area of use and consequently present an inconvenience to the user of a sanitary wipe. It would therefore be desirable to store toiletries in a device that also performs the function of holding a roll of toilet paper tissue which is mounted to the device for immediate dispensing. The present invention combines the function of toilet paper dispensing with the storage of sanitary wipes or other hygiene items such that both are at the immediate disposal of the user.

SUMMARY OF THE INVENTION

There is therefore provided according to the present invention a hygienic device for holding toiletries and dispensing a roll of toilet tissue paper that consists of a sanitary tray of parallelogram shape that has a horizontal bottom-wall or base from which extends a vertical peripheral wall forming the boundary of an open void region. To dispense a roll of toilet paper, the sanitary tray carries a holder member that is removably mounted to the bottom-wall. The roll of toilet tissue paper is held by the holding member in telescopic and rotational relationship so as to permit the toilet tissue paper to be dispensed upon rotation of the roll of toilet tissue paper with respect to the holder member. A sleeve having a cavity for holding the sanitary wipes or toiletries is so dimensioned and proportioned to be removably carried at least in part within the open void region of the sanitary tray. To cover the cavity in the sleeve, a cover is pivotally carried by the sanitary tray which can be pivoted to an open position or to a closed position. When in a closed position, the cavity in the sleeve member is covered.

In the preferred embodiment of the invention, the holder member has an upper arm and a lower arm integrally connected by a bight portion where said upper arm is removably mounted to the bottom-wall and the lower arm is so dimensioned and proportioned to receive the roll of toilet tissue paper in telescopic relationship to permit rotation of the roll of tissue paper relative the lower arm.

BRIEF DESCRIPTION OF THE DRAWINGS

These and other features and advantages will become appreciated as the same become better understood with reference to the following specification, claims and drawings wherein:

DETAILED DESCRIPTION

Figure 1:
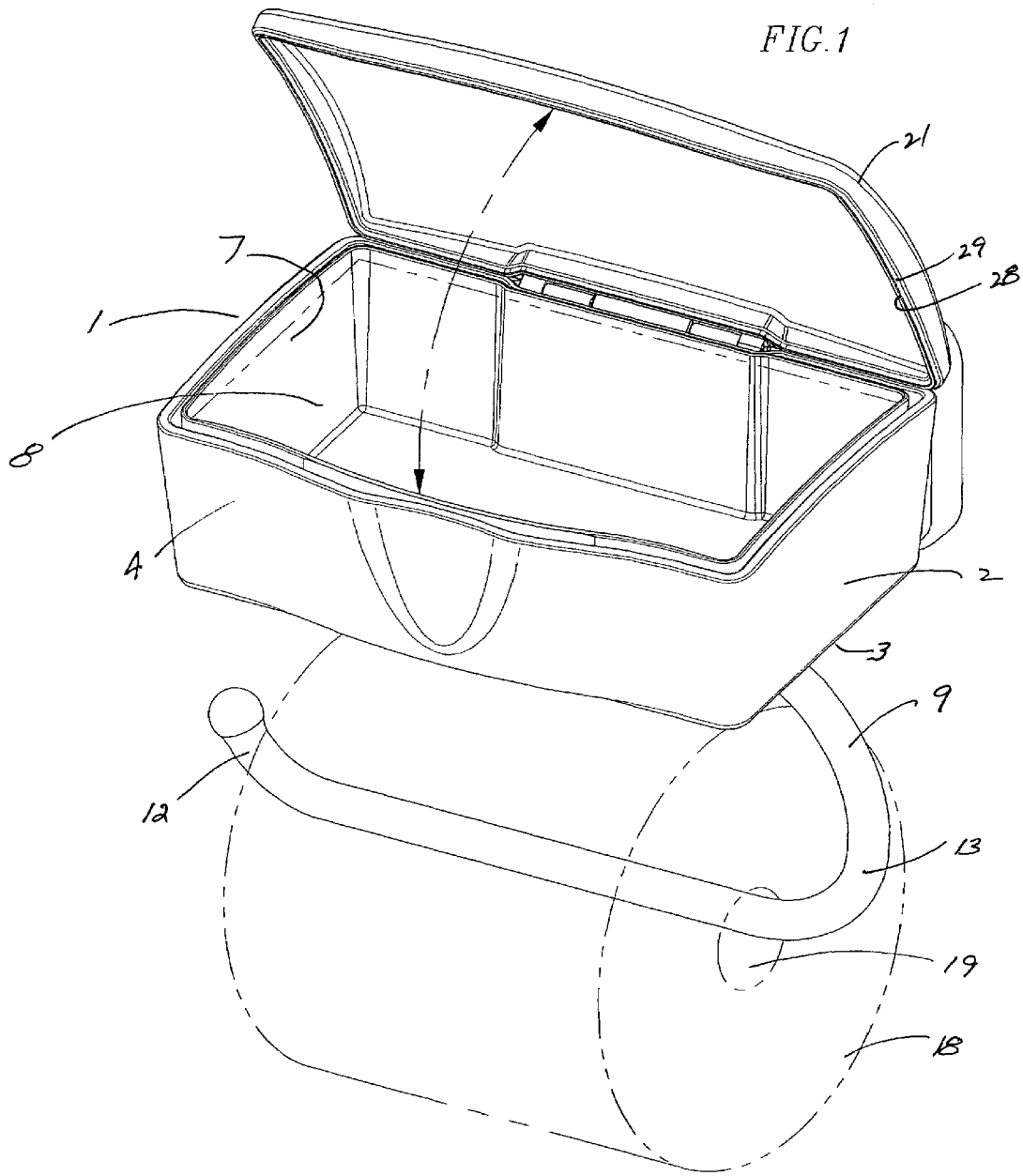
FIG. 1 is a perspective view of the device of this invention for holding toiletries and dispensing a roll of toilet tissue paper illustrating the cover in an open position.

FIG. 1 is an illustration of the bathroom hygiene combination device for holding toiletries such as sanitary wipes and for dispensing a roll of toilet tissue paper. As can be seen in FIG. 1, the bathroom hygiene combination device 1 is composed of a sanitary tray 2 that has a horizontal bottom-wall 3 which can more clearly be seen in FIG. 2. Sanitary tray 2 may have a parallelogram shape but in the embodiment illustrated in FIG. 1, the parallelogram shape is rectangular. Sanitary tray 2 is made of a cast brass material and may have a chrome, nickel, polished brass, or antigued brass material finish.

Figure 2:
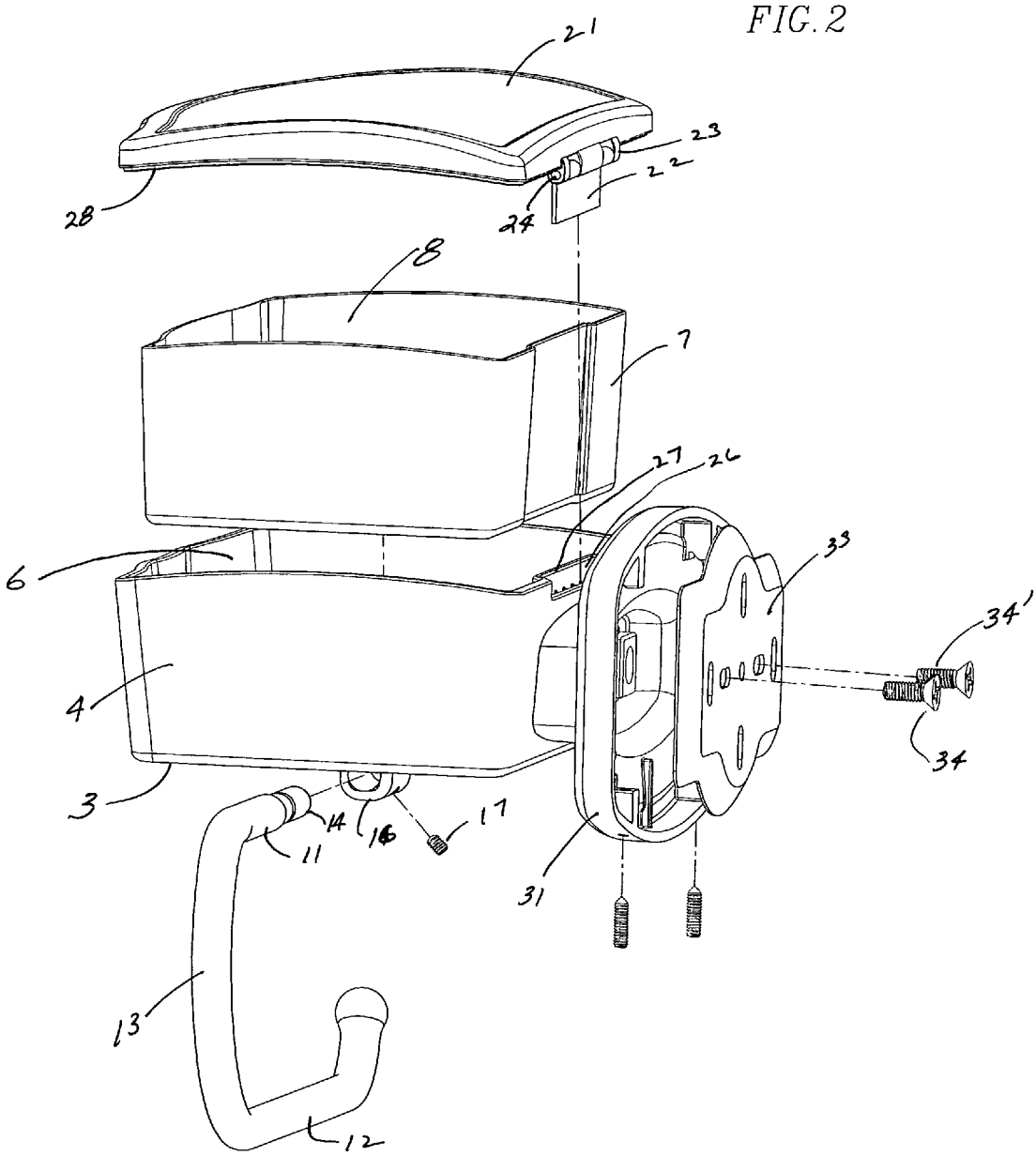
FIG. 2 is an exploded right side perspective view of the invention illustrated in FIG. 1.

Referring to FIGS. 1 and 2, it can be seen that horizontal bottom-wall 3 has a vertically extending peripheral side wall 4 and an open void region 6 that is bounded by bottom-wall 3 and peripheral side wall 4. A sleeve 7 having a cavity 8 is so dimensioned and proportioned such that sleeve 7 is insertable into the open void region 6 of sanitary tray 2 when hygiene combination device 1 is assembled. The material of which sleeve 7 is made is a cast brass material and may have a chrome, nickel, polished brass, or antigued brass material finish. As can further be seen in FIGS. 1 and 2, holder member 9 has an upper arm 11 and a lower arm 12 which are interconnected by bight portion. Holder member 9 is removably mounted to bottom-wall 3 by the first end 14 of upper arm 11 slidably engaging receptable member 16 and locked therewith by socket set screw 17. In FIG. 1, roll of toilet tissue paper 18 is shown in phantom lines where lower arm 12 telescopically extends into cylindrical void 19 of roll 18 telescopically so as to permit rotation of roll 18 with respect to holder member 9. By referring to FIG. 3, it can be seen that the lower arm 12 of holder member 9 is sufficiently spaced vertically from upper arm 11 to permit the roll of toilet tissue to rotate with respect to upper arm 11 and permit the toilet tissue to be dispensed. Holder member 9 may be made of a cast brass material and have material finish of chrome, nickel, polished brass or antigued brass.

Cover 21 is illustrated in the open position in FIG. 1 and in the closed position in Figure. Cover 21 is so proportioned and dimensioned such that in the closed position, void region 6 of sanitary tray 7 is enclosed and cavity 8 is likewise covered and closed. In the illustrated embodiment, cover 21 is pivotally mounted to peripheral side wall 4 of sanitary tray 2. As can be seen in FIG. 2, cover 21 carries a hinge plate 22 which is pinned to hinge receptable 23 by hinge pin 24. Hinge plate mount 27 is attached to sanitary tray 2 and has a slot 27 for receiving hinge plate 22.

To from a seal when cover 21 is closed, gasket 28 which is made of an adhesive backed silicone elastomer material is adhesively attached to cover 21 and extends peripherally to the bottom peripheral edge 28 of cover 21 to form the seal when cover 21 is closed.

Figure 3:
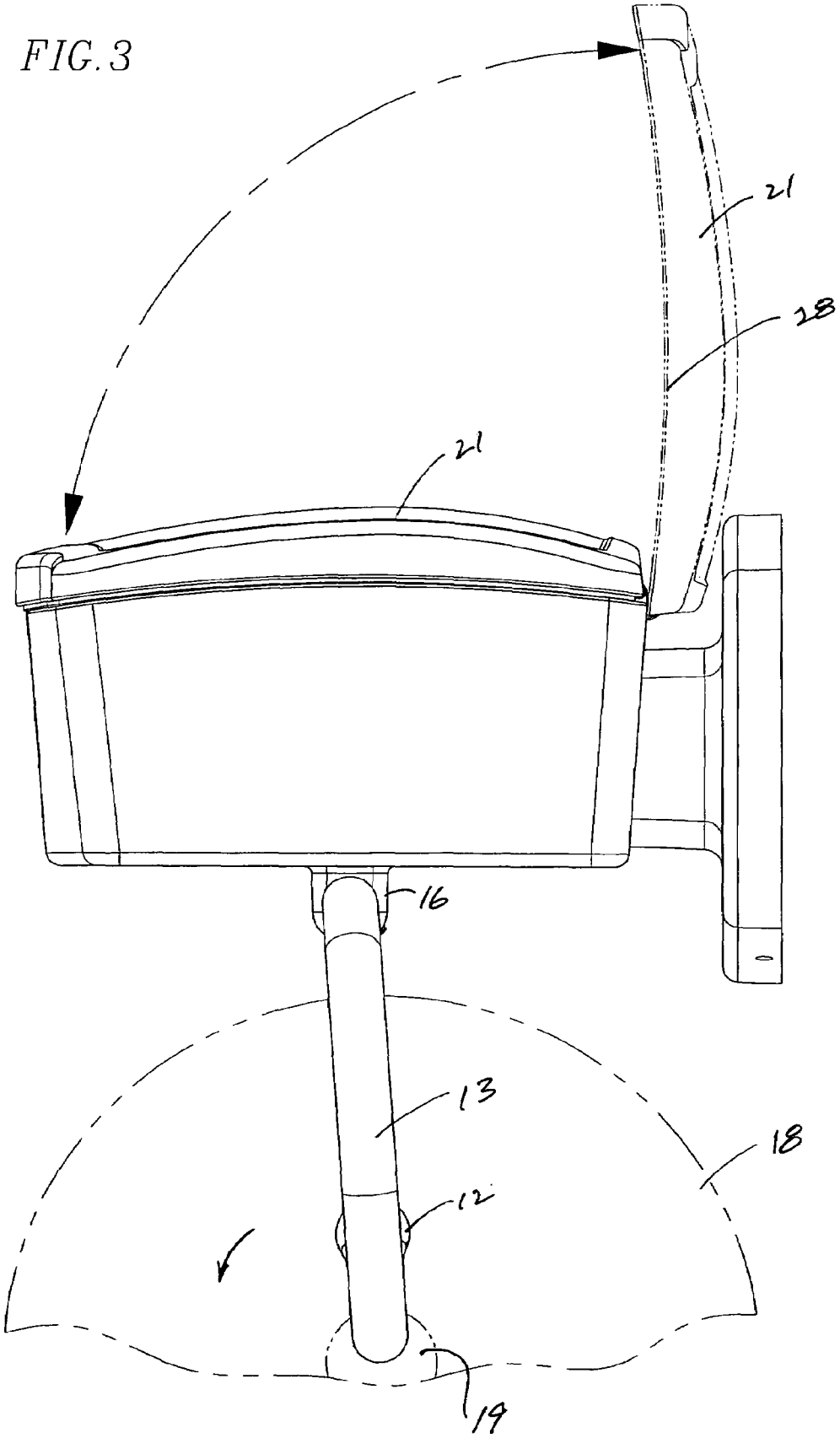
FIG. 3 is an assembled right side view of the invention shown in FIG. 1 illustrating the cover in a closed position.

In the embodiment shown in FIGS. 2 and 3, a sanitary tray mount member 31 for attaching sanitary tray 2 to a wall support is shown. Wall mount plate 33 is preferably made of a stainless steel material and may be fixed to a wall support by fasteners 34 and 34'. Socket set screws 36 and 36' are shown in FIG. 2 for securing sanitary tray mount member 31 to wall mount plate 33.

While I have shown and described an embodiment of a hygienic device for holding toiletries and dispensing a roll of toilet tissue paper, it is to be understood that the invention is subject to many modifications without departing from the scope and spirit of the claims as recited herein.

What is claimed is:

1. A hygienic device for holding toiletries and dispensing a roll of toilet tissue paper, comprising:

a) a sanitary tray having a bottom-wall, a peripheral wall extending vertically from said bottom-wall, and an open void region bounded by said bottom-wall and said peripheral wall;

b) a holder member comprising an upper arm, a bight portion, and a lower cantilever arm where said lower cantilever arm has a fixed end and a free end, and where said fixed end and said upper arm are integrally connected to said bight portion, said holder member carried by said sanitary tray for holding said roll of toilet tissue paper intermediate said fixed and free end in telescopic slidable relationship with respect to said free end and in rotational relationship with respect to said lower cantilever arm so as to permit said roll of toilet tissue paper to be insertable over said free end and dispensed upon rotation of said roll of toilet tissue paper with respect to said cantilever lower arm;

c) a sleeve having a cavity for holding said toiletries where said sleeve is so dimensioned and proportioned to be removably carried at least in part within said open void region; and d) cover means for covering and sealing said sleeve cavity.

2. The hygienic device recited in claim 1 where said holder member is mounted to said bottom-wall.

3. The hygienic device recited in claim 2 where said bottom-wall has a parallelogram shape.

4. The hygienic device recited in claim 3 where said lower cantilever arm is so dimensioned and proportioned to slidably receive said roll of toilet tissue paper in telescopic relationship and to permit rotation of said roll of toilet tissue paper relative to said lower cantilever arm.

5. The hygienic device recited in claim 4 where said parallelogram shape is rectangular.

6. The hygienic device recited in claim 4 where said parallelogram shape is a square shape.

7. The hygienic device recited in claim 1 where said cover means comprises a cover and a gasket member carried by said cover for sealing said sleeve where said cover is pivotally carried by said sanitary tray.

8. The hygienic device recited in claim 7 where said holder member is removably mounted to said bottom-wall.

9. The hygienic device recited in claim 8 where said bottom-wall has a parallelogram shape.

10. The hygienic device recited in claim 9 where said lower cantilever arm is so dimensioned and proportioned to slidably receive said roll of toilet tissue paper in telescopic relationship and to permit rotation of said roll of toilet tissue paper relative to said lower cantilever arm.

11. The hygienic device recited in claim 10 where said parallelogram shape is rectangular.

12. The hygienic device recited in claim 1 further comprising attachment means carried by said sanitary tray for attaching said sanitary tray to a support wall.

13. In combination:

a) a roll of toilet tissue paper and b) a hygienic device for holding toiletries and dispensing said toilet tissue paper comprising a sanitary tray having a bottom-wall, a peripheral wall extending vertically from said bottom-wall, and an open void region bounded by bottom-wall and said peripheral wall; a holder member comprising an upper arm, a bight portion, and a lower cantilever arm where said lower cantilever arm has a fixed end and a free end, and where said fixed end and said upper arm are integrally connected to said bight portion, said holder member carried by said sanitary tray for holding said roll of toilet tissue paper intermediate said fixed and free end in telescopic slidable relationship with respect to said free end and in rotational relationship with respect to said lower cantilever arm so as to permit said roll of toilet tissue paper to be insertable over said free end and dispensed upon rotation of said roll of toilet tissue paper with respect to said cantilever lower arm;

c) a sleeve having a cavity for holding said toiletries where said sleeve is so dimensioned and proportioned to be removably carried at least in part within said open void region; and d) cover means for covering and sealing said sleeve cavity.

14. The combination recited in claim 13 further comprising attachment means carried by said sanitary tray for attaching said sanitary tray to a support wall.

15. The combination recited in claim 13 where said cover means comprises a cover and a gasket member carried by said cover for sealing said sleeve where said cover is pivotally carried by said sanitary tray.

16. The combination recited in claim 13 where said holder member is removably mounted to said bottom-wall.

17. The combination recited in claim 16 where said lower cantilever arm is so dimensioned and proportioned to slidably receive said roll of toilet tissue paper in telescopic relationship and to permit rotation of said roll of toilet tissue paper relative to said lower cantilever arm.

18. The combination recited in claim 13 where said bottom-wall has a parallelogram shape.

* * * * *